US005248120A

United States Patent [19]

Brien

[11] Patent Number: 5,248,120

[45] Date of Patent: Sep. 28, 1993

[54] ROCKER MECHANISM FOR ROCKING CHAIRS

[76] Inventor: Jacques Brien, 123 Haut de la Rivière, St-Césaire, Québec), Canada, J0L 1T0

[21] Appl. No.: 897,084

[22] Filed: Jun. 11, 1992

[30] Foreign Application Priority Data

Feb. 25, 1992 [CA] Canada ..... 2061806

[51] Int. Cl.[5] ..... A47G 29/00

[52] U.S. Cl. ..... 248/370; 297/281

[58] Field of Search ..... 248/370, 202.1; 297/281, 282, 273; 384/438; 5/124

[56] References Cited

U.S. PATENT DOCUMENTS

| | | | |
|---|---|---|---|
| 1,965,785 | 7/1934 | Vallone | 297/281 X |
| 2,065,869 | 12/1936 | Owens | 384/438 X |
| 2,311,482 | 2/1943 | Smith | 297/281 X |
| 2,567,612 | 9/1951 | McGehee | 248/370 X |
| 4,700,920 | 10/1987 | Horn | 297/281 X |
| 4,707,026 | 11/1987 | Johansson | 248/370 X |
| 5,024,483 | 6/1991 | Kamman | 297/273 |
| 5,129,737 | 7/1992 | Stenner | 384/438 X |

*Primary Examiner*—J. Franklin Foss
*Attorney, Agent, or Firm*—Swabey Ogilvy Renault

[57] ABSTRACT

A rocker mechanism for rocking furniture, such as rocking chairs, comprises an elongated tubular casing of rectangular cross-section into which is fixedly mounted a stamped member slidable therein. The stamped member includes an elongated oblong base from which perpendicularly extends a short sidewall along the complete periphery thereof. The stamped member further defines a pair of openings and a pair of curved protrusions at each longitudinal end thereof, whereby ball bearings can be received at each such ends between the sidewall of the stamped member and a respective protrusion thereof. The central opening of each ball bearing lies opposite a respective opening defined in the stamped member. Two holes are defined in an aligned relation in the base wall of the stamped member and in one wall of the casing, whereby a pair of screws engaging respective aligned holes of the stamped member and of the casing ensure that the member is fixedly secured to the casing. End caps are snapped onto each end of the casing for completely hiding the stamped member located therein. The rocker mechanism is mounted at the ends thereof to a stationary base of the furniture and to a rocking section thereof by way of pins extending respectively therefrom and engaging ball bearings of the rocker mechanisms.

8 Claims, 2 Drawing Sheets

ROCKER MECHANISM FOR ROCKING CHAIRS

BACKGROUND OF THE INVENTION

1. Field of the Invention

The present invention relates to rocking furniture and, more particularly, to a rocker mechanism for rocking chairs.

2. Description of the Prior Art

Recent rocking chairs include a stationary base and a chair suspended on each side of the base by way of pivoted rocker mechanism, whereby the chair can rock relative to the base. Such rocker mechanisms include at the ends thereof a pair of bearings which engage pins extending from the base and from the chair. The bearings are sandwiched between a pair of elongated plates riveted together. The rocker mechanisms and the bearings support the complete weight of the chair as it suspends therefrom. As the chair is repeatedly rocked back and forth, the load applied on the two plates by the chair causes the rocker mechanism to fail and, more particularly, the bearings to loosen within the plates. It is thus necessary to replace the complete rocker mechanism including the two bearings.

Furthermore, the above rocker mechanisms are somewhat unsightly as they each include two formed plates mounted one to the other by way of rivets.

SUMMARY OF THE INVENTION

It is therefore an aim of the present invention to provide an improved rocker mechanism for rocking chairs which is of solid design, whereby it does not need to be replaced.

It is also an aim of the present invention to provide a rocking mechanism of aesthetic design.

Therefore, in accordance with the present invention, there is provided a rocking apparatus for rocking furnitures which comprises a rigid elongated tubular casing, an inner member slidable in the casing and adapted to be mounted thereto, and a pair of bearing means adapted to be mounted at opposed ends of the inner member. The casing defines a pair of openings on each of two opposed sides thereof and near respective ends of the casing. The openings are aligned in pairs with the bearing means for pivotally mounting parts of the furniture thereto.

In a more specific construction in accordance with the present invention, the casing is of rectangular cross-section and the inner member comprises an elongated stamped member which includes an oblong-shaped bottom wall and a short endless sidewall extending at right angles from a periphery thereof. The stamped member defines near each end thereof a circular hole and a concave protrusion. The hole is located between the end of the stamped member and the protrusion. Therefore, the bearing means are frictionally engaged between respective arrangements of the protrusion and an end curved portion of the sidewall, wherein each of the bearing means is aligned with a respective hole of the stamped member and two respective openings of the casing along a pivot axis.

In a further specific construction, the bearing means each comprise a ball bearing. The casing and the stamped member are each made of a metallic material.

In a still further specific construction, a pair of first apertures are defined in the stamped member inwards of the protrusions. The first apertures each define a short substantially tubular sidewall with one of the two opposed sides of the casing defining a second pair of apertures aligned with the first pair of apertures. The stamped member is secured to the casing by screws adapted to engage the firs and second apertures.

In a still further specific construction, the screws each comprise a substantially V-shaped groove defined substantially transversely against at least part of the threads thereof. Therefore, when the screws are engaged in the first and second apertures, the screws dig a complementary inner thread in the sidewalls of the first apertures for securing the screws thereto and thus the stamped member to the casing.

In a still further specific construction, plastic end caps are fitted at longitudinal ends of said casing and the longitudinal edges of the casing are rounded. Also, a longitudinal rib can be defined in the stamped member between the protrusions.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
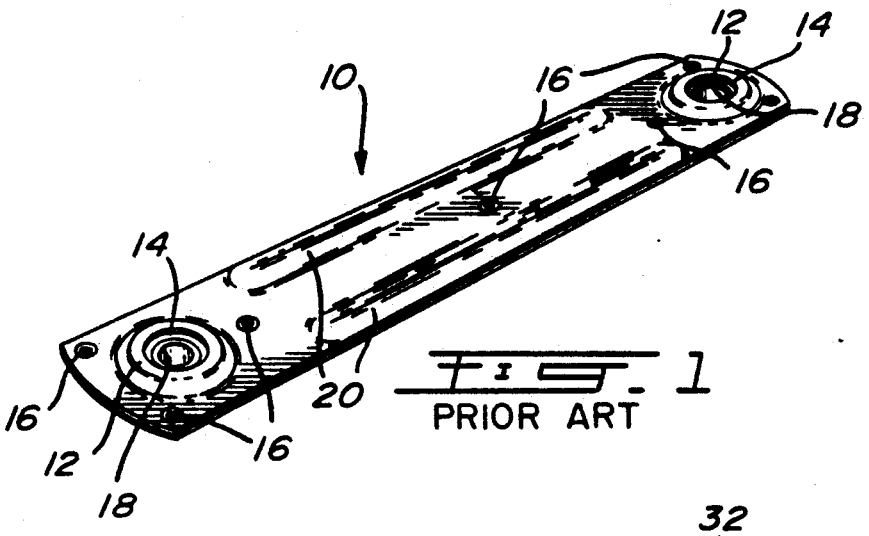
FIG. 1 PRIOR ART
FIG. 1 is a perspective view of one of the two plates of a prior art rocker mechanism for rocking chairs.

Prior art rocker mechanisms as generally described hereinabove each comprise a pair of elongated stamped members, one of which being illustrated in FIG. 1 and referenced with the numeral 10. At each extremity of the stamped member 10 is formed a recess 12 defining an opening 14 at its center. The stamped member 10 also defines a series of holes 16. Prior to assembly of two stamped members 10, a ball bearing 18 is mounted in each of the recesses 12 of one of the stamped member 10. Then, a second stamped member which is identical to the first stamped member is positioned against the first stamped member 10 while receiving the protruding parts of the ball bearings 18 which thus become sandwiched between the two stamped members 10. The stamped members 10 are fixedly mounted one to the other by way of rivets which engage the holes 16 thereof. A pair of parallel elongated recesses 20 are defined longitudinally on the stamped member 10 between the ball bearing receiving recesses 12 thereof probably in order to increase the solidity of the stamped member.

On the other hand, as such stamped members 10 are of limited rigidity with respect to the considerable loads applied thereon, that is the weight of the rocking part of the chair in addition to the weight of the user, the rocker mechanisms of the prior art are subject to substantially rapid failure. The stresses applied to the stamped members 10 cause at some point the ball bearings 18 to loosen within their respective recesses 12. Such behavior prevents a fluid rocking motion of any chair adapted with such prior art mechanisms. Also, the prior art rocker mechanisms are somewhat unsightly as showing a pair of stamped plates 10 defining recesses 12 and joined together by rivets through the opening 16 thereof.

Figure 3:
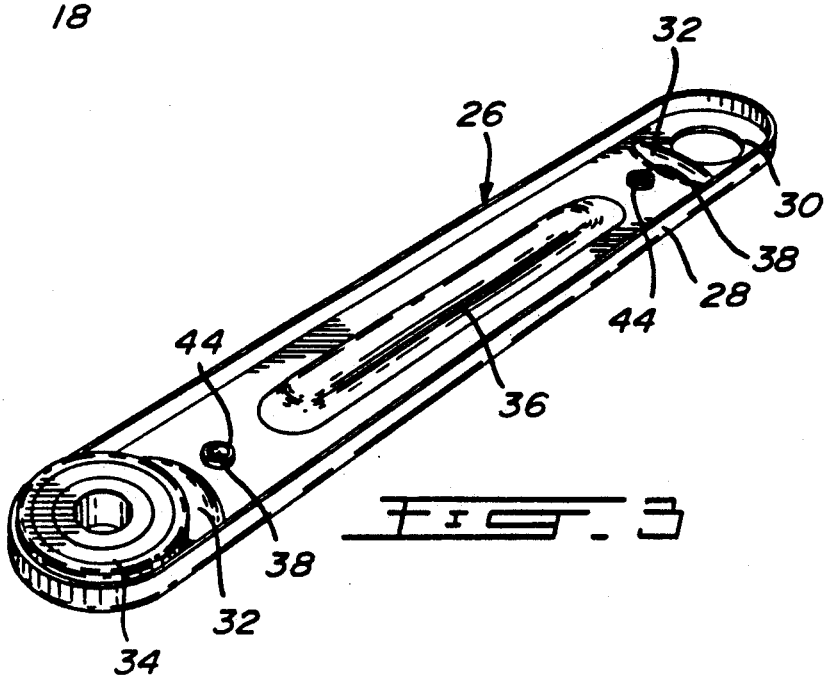
FIG. 3 is a perspective view of the inside stamped member of any of the rocker mechanisms illustrated in FIG. 2.
Figure 4:
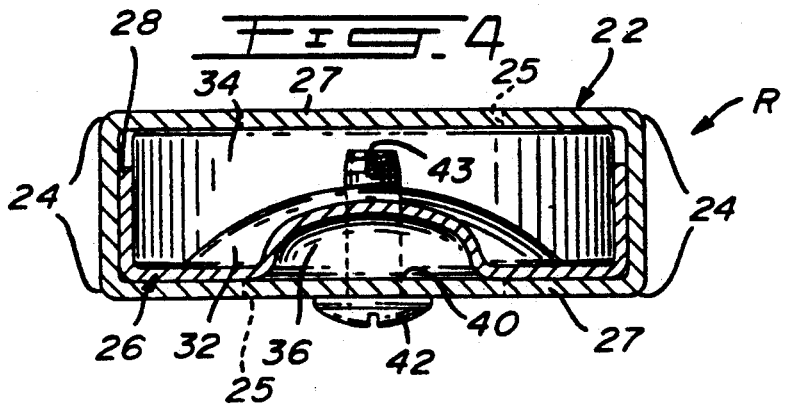
FIG. 4 is a cross-sectional view of the present rocker mechanism taken along lines 4-4 of FIG. 2.
Figure 2:
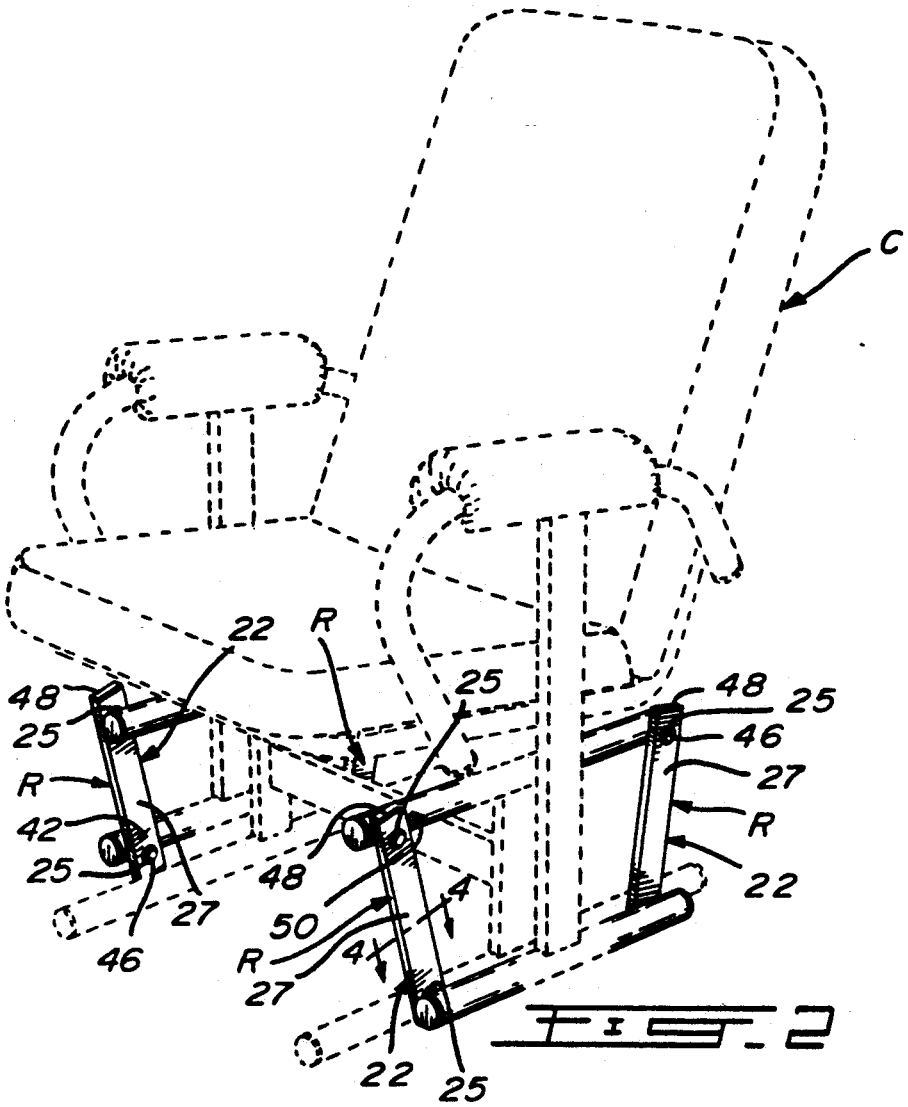
FIG. 2 is a perspective view of rocker mechanisms in accordance with the present invention shown in use on a chair partly illustrated in phantom lines.
Figure 5:
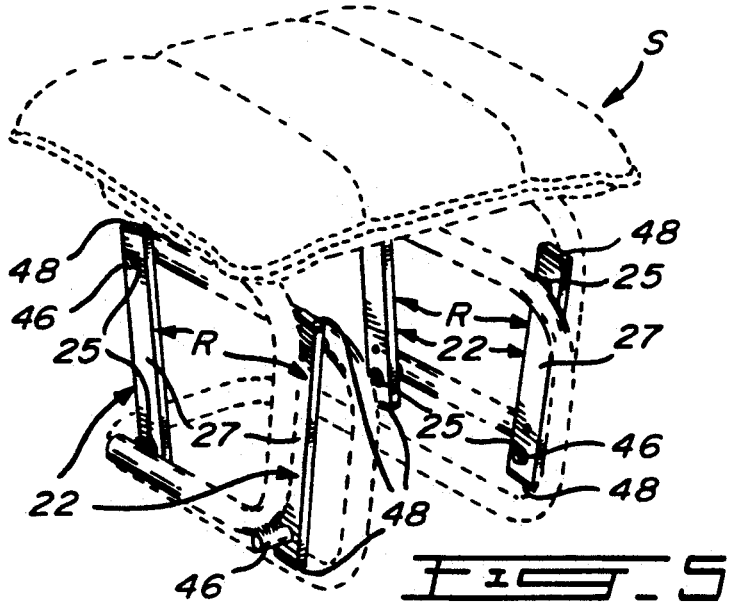
FIG. 5 is a perspective view of a foot stool shown partly in phantom lines and embodying rocker mechanisms in accordance with the present invention.

Therefore, in accordance with the present invention, there is provided an improved rocker mechanism R illustrated in details in FIGS. 3 and 4 and shown in operation on a rocking chair C and on a rocking foot stool S in FIGS. 2 and 5, respectively. More particularly, each rocker mechanism R includes an elongated tubular casing 22 of rectangular crosssection, as best seen in FIGS. 2 and 4. As seen in FIG. 4, the longitudinal corner edges 24 of the elongated casing 22 are rounded for aesthetic purposes. The casing 22 defines two pairs of aligned circular holes 25 on opposed longitudinal surfaces 27 thereof.

A stamped member 26 is slidably inserted in the elongated casing 22, as seen in FIG. 4, with the stamped member 26 being shown in a perspective view in FIG. 3 without the enclosing casing 22.

With reference to FIG. 3, the stamped member 26 is of general oblong longitudinal shape and includes a short endless sidewall 28 extending at right angles from the periphery thereof. At each end of the stamped member 26 is defined an opening 30 and a curved protrusion 32 of inner concave outline. Between the end curved portion of the sidewall 28 and each of the protrusions 32 is frictionally wedged a ball bearing 34, one of which being illustrated at one of the ends of the stamped member 26 of FIG. 3. For added rigidity, a longitudinal oblong rib is defined centrally along the stamped member 26 between both end protrusions 32 thereof. A pair of small holes 38 have also been stamped in the stamped member 26 between each of the ends of the rib 36 and a respective protrusion 32.

When the stamped member 26 is completely inserted in the casing 22, as shown in FIG. 4, the openings 30 of the stamped member 26 and thus the ball bearings 34 are concentrically aligned with respective pairs of the holes 27 of the casing 22. Also, the holes 38 of the stamped member 26 lie opposite a pair of further holes 40 defined on one the walls 27 of the casing 22. The stamped member 26 is fixedly mounted within the casing 22 by way of a pair of screws 42 which engage respective holes 38 and 40 of the stamped member 26 and of the casing 22. The screws 42 each comprise a V-shaped groove 43 defined substantially transversely against the threads of the screw 42 from the free end of the screw 42 towards the head thereof, thereby defining sharp cutting edges. It is noted that when the member 26 is stamped, the forming of the holes 38 thereof define short tubular sidewalls 44, as seen in FIG. 3. Therefore, when the screws 42 are engaged in the tubular sidewalls 44 of the holes 38 of the stamped member 26, the screws 42 and, more particularly, the grooves 43 thereof each form a thread within the tubular sidewall 44, whereby the screws 42 are well secured to the assembly of the casing 22 with the stamped member 26.

It is easily understood from the above assembly of the casing 22 with the stamped member 26 that the rocker mechanism R so produced is very rigid due principally to the tubular shape of the casing 22. This construction prevents the ball bearings 34 from loosening in the stamped member 26 and thus in the casing 22. Furthermore, the present rocker mechanism R is very esthetic as the stamped member 26 is hidden inside the casing 22 which is of a pleasant configuration. As opposed to the device of the prior art, the present rocker mechanism R can be positioned in order that the screws 42 thereof are located on the inside when the rocker mechanism R is assembled to the chair C or to the stool S of FIGS. 2 and 5, respectively, whereby the screws 42 are substantially hidden under the furniture. In the device of the prior art, the thickness of the two stamped members 10 applied one against the other is small enough that the means for mounting the members together must extend through both members 10, whereby rivets are used.

It is also easily understood from the above and from FIGS. 2 and 5 that the present rocker mechanism R is mounted at each end thereof to a fixed part of the chair and to a rocking part thereof by way of horizontally extending pins 46 which are engaged in respective ball bearings 34 so as to protrude slightly therefrom.

Plastic end caps 48 are fitted at the ends of the casing 22 for aesthetically closing the casing 22 and thus hiding the stamped member 26 located therein. Stoppers 50 can also be mounted to a fixed part of the chair adjacent the rocker mechanism R in order to limit the locking of the chair with respect to its fixed base.

It is readily understood from the enclosed description and drawings that the rocker mechanism R in accordance with the present invention is of solid construction as the loads applied thereto are mainly handled by the very strong tubular casing 22, with limited stresses being applied to the stamped member 26 and to the ball bearings 34, the latter being strongly secured in the casing 22 and restricted in deflection thereby. Such a construction prevents the failure of the stamped member 26 and of the ball bearings 34, and also prevents the ball bearings 34 from loosening from the stamped member 26 and thus providing a less than fluid rocking motion to the chair C or to the foot stool S. The stamped member 26 is obviously of low cost manufacture with the tubular casing being also of substantially low cost. Therefore, the rocker mechanism in accordance with the present invention, albeit of higher cost than the rocker mechanisms of the prior art, is still relatively cheap to manufacture while being considerably more esthetic, stronger and thus more durable.

The embodiments of the invention in which an exclusive property or privilege is claimed are defined as follows:

1. A rocking apparatus for rocking furnitures, comprising a rigid elongated tubular casing, an elongated inner member, and a pair of bearing means adapted to be mounted at opposed ends of said inner member, said inner member and said pair of bearing means, when assembled, being slidable in said casing and being adapted to be detachably mounted to said casing while being enclosed therein, said casing defining a pair of openings on each of two opposed sides thereof and near respective ends of said casing, said openings being aligned in pairs with said bearing means for pivotally mounted parts of the furniture thereto.

2. A rocking apparatus as defined in claim 1, wherein said casing is of rectangular cross-section, and wherein said inner member comprises an elongated stamped member including an oblong-shaped bottom wall and a short endless sidewall extending at right angles from a periphery thereof, said stamped member defining near each end thereof a circular hole and a concave protrusion, said hole being located between said end and said protrusion, whereby said bearing means are frictionally engaged between respective arrangements of said protrusion and an end curved portion of said sidewall, wherein each of said bearing means is aligned with a respective hole of said stamped member and two respective openings of said casing along a pivot axis.

3. A rocking apparatus as defined in claim 2, wherein said bearing means each comprise a ball bearing.

4. A rocking apparatus as defined in claim 2, wherein said casing and said stamped member are each made of a metallic material.

5. A rocking apparatus as defined in claim 2, wherein a pair of first apertures are defined in said stamped member inwards of said protrusions, said first apertures each defining a short substantially tubular sidewall, one of said two opposed sides of said casing defining a second pair of apertures aligned with said first pair of apertures, said stamped member being secured to said casing by screws adapted to engage said first and second apertures.

6. A rocking apparatus as defined in claim 5, wherein said screws each comprise a substantially V-shaped groove defined substantially transversely against at least part of the threads thereof, whereby when said screws are engaged in said first and second apertures said screws dig a complementary inner thread in said sidewalls of said first apertures for securing said screws thereto and thus said stamped member to said casing.

7. A rocking apparatus as defined in claim 2, wherein plastic end caps are fitted at longitudinal ends of said casing, and wherein longitudinal edges of said casing are rounded.

8. A rocking apparatus as defined in claim 2, wherein a longitudinal rib is defined in said stamped member between said protrusions.

* * * * *